United States Patent [19]

Flanagan, Jr. et al.

[11] 3,994,080

[45] Nov. 30, 1976

[54] EIGHT-IN-ONE-SHOE

[75] Inventors: Joseph Marion Flanagan, Jr.; Gloria Motley Flanagan, both of Myrtle Beach, S.C.

[73] Assignee: Joseph Marion Flanagan, Jr., Myrtle Beach, S.C.

[22] Filed: Feb. 25, 1975

[21] Appl. No.: 505,920

[52] U.S. Cl. ..... 36/100

[51] Int. Cl.[2] ..... A43B 3/24

[58] Field of Search ..... 36/2.5 R, 2.5 C, 2.5 W, 36/100, 101

[56] References Cited

UNITED STATES PATENTS

| | | | |
|---|---|---|---|
| 2,068,946 | 1/1937 | Ferguson | 36/2.5 C |
| 2,236,367 | 3/1941 | Gruber | 36/2.5 C |
| 2,761,224 | 9/1956 | Gardiner | 36/2.5 W |

*Primary Examiner*—Patrick D. Lawson

[57] ABSTRACT

This shoe is made with Black Suede on White Suede. The Black Suede can be covered by removing the tops of the snaps and applying another color of suede of same sized pieces onto the bottom of the snaps with the color of the suede. The shoe would have seven different color pieces of suede: Red, blue, yellow, brown, green, purple, orange, and enough color snaps for every color of suede. This makes the shoe eight-in-one.

2 Claims, 5 Drawing Figures

FIG. 1
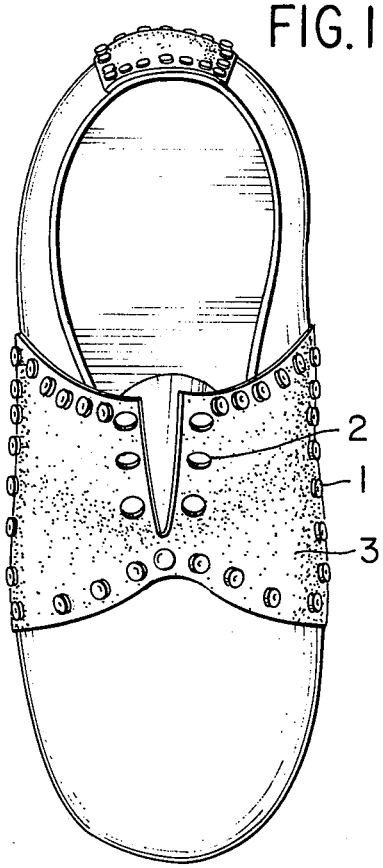
FIG. 2
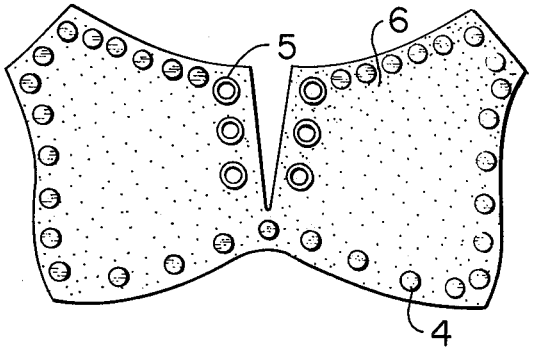
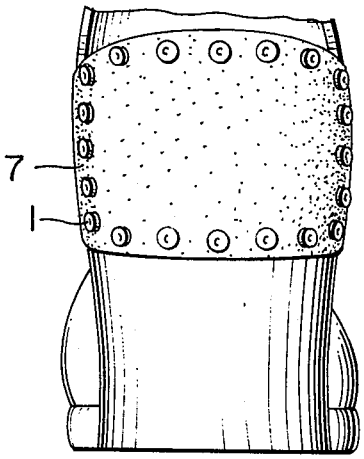
FIG. 3
FIG. 4
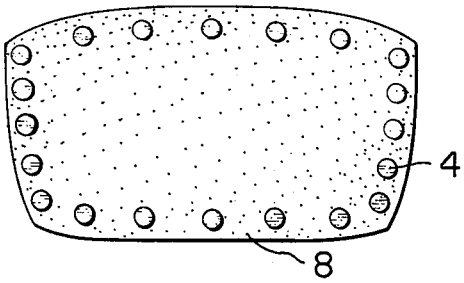
FIG. 5
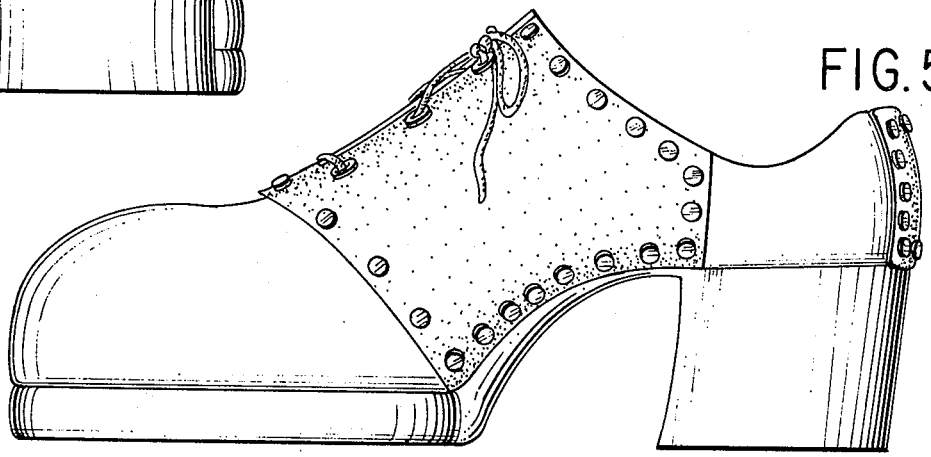

EIGHT-IN-ONE-SHOE

BACKGROUND OF INVENTION

This invention enables people to match their shoe color to their dress color, using only one pair of shoes. The shoe has eight different color saddle pieces to snap onto the shoe to make eight in one.

SUMMARY OF THE INVENTION

The bottom parts of the snaps are made into the shoe. The top of the snaps are made into the saddle pieces. The eyelets are also made into every saddle. This enables you to snap the saddle part onto the shoe and lace it up as you would do any other shoe. When you want to change the color, unsnap it and unlace, then apply another color, snap into place as before. The back of the shoe also has a piece to match the saddle part, it also snaps into place.

DESCRIPTION OF THE DRAWING

FIG. 1 is a top view of the shoe with the outline of a saddle sewn on. The bottoms of the snaps 1 showing, and holes for the shoe strings to go through 2.

FIG. 2 is the saddle part of the shoe. It shows the tops of the snaps 4 and metal eyelets 5.

FIG. 3 is the back of the shoe, it shows the outline of the back piece, and the bottoms of the snaps 1.

FIG. 4 shows the back piece, with the tops of the snaps showing 4.

FIG. 5 is a side view of the shoe with saddle and back piece attached.

DESCRIPTION OF THE PREFERRED EMBODIMENT

The saddle piece 6 must be snapped into place on the shoe 3, which includes a stitched outline of the saddle. 1 is the bottom of the snap, and 4 is the top of the snap. The holes for eyelets 2 are covered with the metal eyelets 5 made on the saddle piece.

There are eight different color saddle pieces made the same way. The colors are black, blue, red, green, brown, purple, orange and yellow.

The back of the shoe 7, which also includes a stitched outline, will match the saddle color 6. There will be eight different colored back pieces 8 also. They will be made the same way as the saddle 6 with bottom of snap 1 made into the back part of shoe 7 and top of snap 4 made into back piece 8.

What is claimed is:

1. A convertible shoe comprising an upper having at least one area thereon outlined with stitching, a plurality of first snap fastener elements attached to said upper within each of said areas, at least one detachable portion configured to the shape of each of said areas, and a plurality of second snap fastener elements attached to each of said portions cooperating with said plurality of first snap fastener elements for securing each detachable portion to its corresponding area of the upper.

2. A convertible shoe as set forth in claim 1, wherein a saddle area and a back piece area are provided.

* * * * *